US007036437B2

(12) United States Patent
Choi et al.

(10) Patent No.: US 7,036,437 B2
(45) Date of Patent: May 2, 2006

(54) PORTABLE TABLE WITH FOLDING LEGS

(75) Inventors: Kwan Jun Choi, Xiamen (CN); Kwang Ho Baik, Xiamen (CN)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/848,445

(22) Filed: May 17, 2004

(65) Prior Publication Data

US 2005/0022701 A1 Feb. 3, 2005

Related U.S. Application Data

(63) Continuation-in-part of application No. 29/180,741, filed on Apr. 29, 2003, now Pat. No. Des. 489,922.

(51) Int. Cl.
*A47B 3/00* (2006.01)

(52) U.S. Cl. ..... 108/118; 108/129; 108/132

(58) Field of Classification Search ..... 108/115, 108/129, 130, 131, 132; 248/188.1, 188.6, 248/188.7, 188.8

See application file for complete search history.

(56) References Cited

U.S. PATENT DOCUMENTS

| | | | | |
|---|---|---|---|---|
| 2,572,205 | A * | 10/1951 | Shanks | 248/188.6 |
| 3,357,729 | A | 12/1967 | Krueger | |
| 3,525,492 | A * | 8/1970 | Kaufman et al. | 248/188.6 |
| 3,709,159 | A * | 1/1973 | Oglesby, Jr. | 108/44 |
| D235,834 | S | 7/1975 | Payne | |
| 4,288,052 | A * | 9/1981 | Scott | 248/188.6 |
| 4,444,124 | A | 4/1984 | Burr | |
| 5,109,778 | A | 5/1992 | Berkowitz et al. | |
| 5,528,997 | A | 6/1996 | Miller | |
| 6,401,631 | B1 * | 6/2002 | Kane et al. | 108/116 |
| 6,431,092 | B1 * | 8/2002 | Stanford | 108/132 |
| 6,490,981 | B1 * | 12/2002 | Isensee et al. | 108/50.02 |
| 6,732,663 | B1 * | 5/2004 | Tsai | 108/132 |

* cited by examiner

*Primary Examiner*—Jose V. Chen
(74) *Attorney, Agent, or Firm*—Workman Nydegger

(57) ABSTRACT

A table may include a tabletop and the tabletop is preferably constructed from blow-molded plastic. The table may also include a first leg that is movable between an extended position and a collapsed position relative to the tabletop, and a second leg that is movable between an extended position and a collapsed position relative to the tabletop. In addition, the table may include a first foot member that is rotatably connected to the first leg and a second foot member connected to the second end of the second leg. The first foot member may be rotated between a first position and a second position to allow the first leg and the second leg to be moved between the extended and collapsed positions.

27 Claims, 7 Drawing Sheets

PORTABLE TABLE WITH FOLDING LEGS

CROSS-REFERENCE TO RELATED APPLICATIONS

This application is a continuation-in-part of U.S. Design patent application Ser. No. 29/180,741, which was filed Apr. 29, 2003, entitled PORTABLE TABLE WITH FOLDING LEGS, now U.S. Pat. No. D489,922, which is hereby incorporated by reference herein in its entirety.

BACKGROUND OF THE INVENTION

1. Field of the Invention

The present invention generally relates to furniture and, in particular, to tables with folding legs that can be selectively moved between extended and collapsed positions.

2. Description of Related Art

Conventional tables typically include a tabletop and one or more legs. The legs are frequently directly connected to the tabletop to support the table top above a surface such as the floor. Many conventional tables include legs that are foldable relative to the tabletop to allow the table to be more easily transported and stored. In particular, conventional tables often include legs that are pivotally attached to the tabletop to allow the legs to be moved between an extended position in which the legs extend outwardly from the tabletop and a collapsed or storage position in which the legs are positioned near or adjacent to the tabletop. Thus, when the table is desired to be used, the legs are placed in the extended position. On the other hand, when the table is desired to be transported or stored, the legs can be placed in the collapsed or storage position.

Many conventional tables with legs that are movable between the extended and collapsed positions include tabletop constructed from materials such as metal or wood. In particular, these conventional tabletops may be constructed from materials such as steel, aluminum, plywood, particle board, fiber board and other types of wooden laminates. These conventional tabletops constructed from metal or wood, however, are often relatively heavy and this may make the table awkward or difficult to move. Conventional tabletops constructed from metal or wood are also relatively expensive and the tabletops must generally be treated or finished before use. For example, tabletops constructed from wood are often sanded and/or painted, and tabletops constructed from metal must be formed or cut into the desired shape and painted or otherwise finished. In addition, metal or wooden tabletops often require a canvas or vinyl cover, which undesirably increases the costs of the table. Further, the metal or wooden tabletops often require frequent maintenance such as repairing, repainting and/or refinishing.

These known tabletops constructed from materials such as plywood, particle board, fiber board and other types of wooden laminates are often not very strong or rigid. Accordingly, these types of tables often cannot support large or heavy items, and these types of tables generally cannot withstand large forces or impacts without breaking, cracking or breaking. For example, wooden tabletops may split, crack or come apart, or the legs may become disconnected from the tabletop, when a large force or impact is applied to the tabletop. Consequently, these tables often require various types of frames and/or braces to strengthen and support the table top. These frames and/or braces often undesirably increase the weight of the tables, which may increase shipping and transportation costs, and manufacturing costs because additional time and resources may be required to construct the tables.

Card tables are well known types of tables that traditionally include tabletops constructed from materials such as plywood, particle board, fiber board or other types of wooden laminates. Card tables are typically lightweight, include tabletops with generally flat upper surfaces, and have four legs that are each independently connected to the tabletop. In particular, the legs of most conventional card tables are independently and pivotally connected to the tabletop by four separate braces. The braces allow each leg to individually fold against the tabletop. Disadvantageously, the user must individually move each of the legs between the collapsed and extended positions. In addition, the user typically must fasten each of the braces into a locked or secured position. Thus, independently moving and securing the four legs between the collapsed and extended positions may require a significant amount of time.

Conventional card tables often include a vinyl or plastic sheet that covers the plywood, particle board, fiber board or wooden laminate tabletop. The vinyl or plastic covering, however, often undesirably increases manufacturing time and costs. The vinyl or plastic covering may also be easily torn or damaged, and it may be very difficult or impossible to satisfactorily repair or replace. In addition, as discussed above, tabletops constructed from plywood, particle board, fiber board or wooden laminates are generally not very strong. Further, the legs are often not securely connected to the tabletop and this may allow the legs to wobble or otherwise undesirably move. The legs may also become disconnected or break away from the tabletop if an excessive load or force is placed on the tabletop or legs. Damaged or broken card tables are typically discarded and new card tables purchased because broken card tables are often difficult to fix or repair.

It is also known to construct tables with tabletops constructed from plastic in order to decrease the weight of the table. The lightweight tables may be easier to move and less expensive to ship. In particular, lightweight tabletops constructed from injection molded plastic are known. Disadvantageously, these lightweight tabletops frequently require reinforcing members or other structural parts such as frames, brackets, support members and the like to strengthen the tabletop. While these additional parts may increase the strength of the tabletop, they undesirably increase the weight of the table. In addition, these additional parts increase manufacturing costs and require additional time to assemble the table. Furthermore, these additional parts may have sharp edges that can injure a user's arms or legs.

Conventional tables may use one or more braces to pivotally attach the legs to the tabletop. Disadvantageously, these braces may limit the leg room and/or storage space under the table. In addition, the braces may be difficult or complicated to use. Further, conventional tables may include a locking mechanism to secure the legs in the extended position, and the locking mechanism may also be difficult or complicated to use. The braces may also interfere with the positioning of the legs against the tabletop when the legs are in the collapsed position. For example, the braces may prevent the legs from being positioned adjacent to or in contact with the underneath surface of the tabletop. This may make the tables more difficult to ship and store because the table may require addition space when the legs are in the collapsed position. Additionally, the table may be more difficult to ship and store if the legs protrude outwardly and away from the tabletop when the legs are in the collapsed position.

Conventional tables may also require that the legs be offset in order to allow the legs to be folded against the underneath surface of the tabletop in the collapsed position. In particular, some known tables require the legs to be offset to allow the legs to be moved into the collapsed position. Disadvantageously, the offset legs may be more difficult to manufacture and use.

BRIEF SUMMARY OF THE INVENTION

A need therefore exists for a table that reduces or eliminates some or all the above-described disadvantages and problems.

One aspect of the invention is a table with one or more legs than may be movable between an extended position and a collapsed position. Advantageously, when the legs are in the extended position, the table can be used to support various items and/or for many different purposes. When the legs are in the collapsed position, the table can be easily transported and stored. Preferably, when the legs are in the collapsed position, the legs are stored near or adjacent to the tabletop. The legs, however, could be removably connected to the tabletop.

Another aspect is a table that may include legs that are pivotally connected to the tabletop. Significantly, if the legs are pivotally connected to the tabletop, then the legs may be quickly and easily moved between extended and collapsed positions. The legs may also be independently connected to the tabletop so that each of the legs can be separately moved between the extended and collapsed positions.

Yet another aspect is a table that may include a frame that is used to attach one or more legs to the tabletop. The frame may include one or more crossbars and the legs may be attached to the crossbars. For example, the table may include two legs and the frame may include two crossbars, and one leg may be connected to each crossbar. The crossbars may be rotatably attached to the tabletop to allow the legs to be pivoted relative to the tabletop. For example, when the legs are in the collapsed position, the crossbars of the frame may be rotated to position the legs proximate or adjacent to a lower surface of the tabletop. On the other hand, when the legs are in the extended position, the crossbars may be rotated to allow the legs to extend outwardly and away from the tabletop. The legs, however, could be directly connected to the frame or the table top. In addition, the table may not require the use of the frame or the frame may simply consist of the crossbars.

Still another aspect is a table that may include one or more legs that are pivot relative to the tabletop between an extended position and a collapsed position. A foot member may be attached to each of the legs. For example, the table could include two legs and a foot may be attached to each leg. One or more of the foot members may be rotated or otherwise moved relative to the leg and/or the tabletop to facilitate moving the legs between extended and collapsed positions.

A further aspect is a table that may be specifically sized and configured to be used by only one person at a time. This type of table may be referred to as a personal table. The table, however, could be larger or smaller and suitable number of persons could use the table.

Another aspect is a table that may be relatively small and lightweight, which may allow the table to be easily moved and transported. The table may also be sized and configured so that it does not take up any unnecessary space.

Still another aspect is a table that may include a tabletop that is constructed from a lightweight material, which may allow a person to readily lift and move the table. For example, the tabletop may be constructed from plastic, such as high density polyethylene, and the tabletop may be constructed by blow-molding. The blow-molded plastic tabletop may be designed to create a relatively rigid, high-strength structure that is capable of withstanding repeated use and wear. In addition, the blow-molded plastic tabletop may form a structural component of the table, which may minimize the number of components required to construct the table. Further, the blow-molded plastic tabletop may easily be manufactured and formed into the desired shape and size.

Yet another aspect is a table that may include a tabletop with one or more features integrally formed in the tabletop. For example, the table could include a blow-molded plastic tabletop and one or more features may be integrally formed in the tabletop during the blow-molding process as part of a unitary, one-piece structure. These features may include, but are not limited to, a recessed portion formed in the bottom of the tabletop or a generally downwardly lip that may form part of an outer edge of the tabletop.

A further aspect is a table that may include a tabletop that is relatively simple to manufacture because it preferably consists of a tabletop constructed from blow-molded plastic. The blow-molded plastic tabletop may include two opposing walls that are spaced apart by a relatively small distance, which may help increase the strength and rigidity of the tabletop. The blow-molded plastic tabletop may also include one or more depressions or tack-offs to further increase the strength of the tabletop and/or interconnect the spaced apart walls. Significantly, the blow-molded tabletop may be lightweight, rigid, durable, weather resistant and generally temperature insensitive. Additionally, the blow-molded plastic tabletop may not corrode, rust or otherwise deteriorate over time. Further, the blow-molded tabletop may also be formed in various shapes, sizes, configurations and designs.

A still further aspect is a table that may be quickly and easily assembled, which may reduce manufacturing and labor costs. For example, the legs may be quickly and easily attached to the tabletop to decrease manufacturing and labor costs.

Another aspect is a table that may be used in wide variety of situations and uses. For example, the table may be used to support various items such as a television, computer, sewing machine, microwave, lamp, luggage, and the like. The table may also be used as a bedside table, coffee table, night stand, desk, shop table, and the like. Further, the table may be used while performing a wide variety of tasks such as reading, writing, studying, working, etc. Thus, the table may be used in a number of different environments and it can perform numerous different tasks.

Yet another aspect is a table that may include a tabletop and a frame. The frame may include a first crossbar and a second crossbar that are connected to the tabletop. The first and second crossbars may be rotatably connected to the tabletop. A first leg and a second leg are connected to the first and second crossbars, respectively. The first and second legs may be movable between an extended position and a collapsed position. A first foot member may be connected to the first leg and a second foot member may be connected to the second leg. One or both of the foot members may be pivotally connected to the legs to allow the legs to be moved between the extended and collapsed positions.

Still another aspect is a method for moving table legs between extended and collapsed positions. The table may include a tabletop, a first leg movable between an extended position and a collapsed position relative to the tabletop, a first foot member connected to the first leg, a second leg movable between an extended position and a collapsed position relative to the tabletop, and a second foot member connected to the second leg. The method may include rotating the first foot member from a first rotational position to a second rotational position; and pivoting the first leg to a position in which the first foot member is positioned beyond the second leg; wherein, when the first foot member is in the first rotational position and when the first leg is pivoted towards a collapsed position, the second leg obstructs the movement of the first foot member beyond the second leg; and wherein, when the first foot member is in the second rotational position and when the first leg is pivoted towards a collapsed position, the first foot member may be positioned beyond the second leg.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages, and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a table with legs that are movable between an extended position and a collapsed position relative to the table top. The principles of the present invention, however, are not limited to tables with legs that are movable between extended and collapsed positions relative to the table top. It will be understood that, in light of the present disclosure, the table disclosed herein can be successfully used in connection with other types of furniture, fixtures and equipment.

Additionally, to assist in the description of the table, words such as top, bottom, front, rear, right and left are used to describe the accompanying figures. It will be appreciated, however, that the present invention can be located in a variety of desired positions—including various angles, sideways and even upside down. A detailed description of the table now follows.

Figure 1:
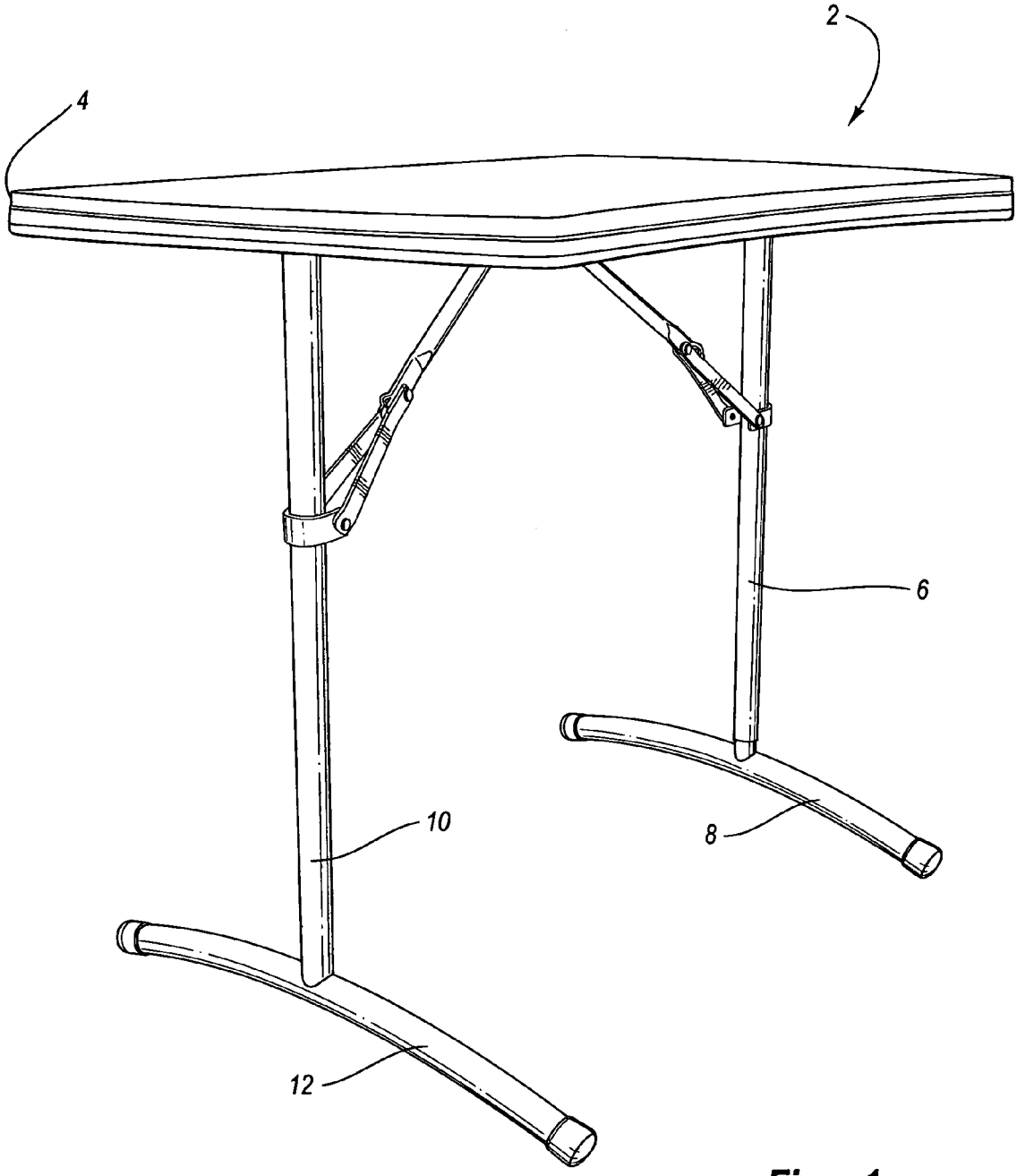
FIG. 1 is a perspective view of an exemplary embodiment of a table, illustrating the legs in an extended or use position.

As shown in FIG. 1, an exemplary embodiment of the table 2 may include a tabletop 4 and one or more leg that are movable between an extended position and a collapsed position relative to the table top. For example, as shown in the accompanying figures, the table 2 may include legs 6 and 10, but the table may include any suitable number of legs such as three or four. The legs 6, 10 are preferably constructed from relatively strong materials such as steel or aluminum, but any materials with suitable characteristics may be used. The legs 6, 10 are preferably in the form of hollow tubes with a generally circular cross-section, but the legs may have any desired shape and configuration depending, for example, upon the intended use of the table 2. As shown in the accompanying figures, the legs 6, 10 may consist of a single elongated member with a generally straight configuration, but the legs could include two or more members and the members could have various shapes and sizes. One skilled in the art will appreciate that the legs 6, 10 could have other suitable shapes and configurations depending, for example, upon the intended use of the table 2.

A foot member is preferably attached to each of the legs. For example, a first foot member 8 may be attached to the first leg 6 and a second foot member 12 may be attached to the second leg 10. The foot members 8, 12 may be attached to the legs 6, 10, respectively, in any suitable manner (e.g., removably, nonremovably, movably, pivotally, rotatably, selectively, securely, and the like) and at any suitable location. The foot members 8, 12. The foot members 8, 12 are preferably constructed from relatively strong materials such as steel or aluminum, but any materials with suitable characteristics may be used. The foot members 8, 12 are also preferably in the form of hollow tubes with a generally circular cross-section so that the foot members have generally the same shape and configuration as the legs 6, 10, but the foot members may have any desired shape and configuration depending, for example, upon the intended use of the table 2.

In greater detail, one or both of the foot members 8, 12 may be rotatably or non-rotatably attached to the legs 6, 10. In particular, the foot member 8 is preferably rotatably attached to the leg 6 and the foot member 8 is preferably non-rotatably attached to the leg 10. Advantageously, as described in more detail below, this may allow the legs 6, 10 to be moved between the extended and collapsed positions. One of ordinary skill in the art will appreciate that the foot member 8 may be non-rotatably attached to the leg 6 and the foot member 12 may be rotatably attached to the leg 10, if desired. One of ordinary skill in the art will also appreciate that both of the foot members 8, 12 may be rotatably attached to the legs 6, 10, if desired. In addition, one skilled in the art will appreciate that the legs 6, 10 and foot members 8, 12 may be separate components that are interconnected or unitary, one-piece components if desired.

The foot members 8, 12 may also be movable between one or more positions. For example, the foot members 8, 12 may be in a normal or first position as shown in FIG. 1. In this position, the foot members 8, 12 are generally parallel to each other and the foot members are generally aligned with the right and left sides of the tabletop 4. The foot members, such as the foot member 8, may be moved from the normal or first position into any other suitable position by any suitable manner. For instance, the foot member 8 may be rotatably connected to the leg 6 and the foot member may be rotated 90 degrees about an axis that is generally aligned with the leg into a second position. Alternatively, the leg 6 and foot member 8 may be rotated 90 degrees relative to the tabletop 4 into the second position. The foot member 8 may be movable into a variety of suitable positions relative to the tabletop 4 such as 90 degrees, 180 degrees, 270 degrees or 360 degrees. The foot member 8 may also be movable into other suitable positions, if desired. The foot member 8 may advantageously be configured to move in a clockwise direction, in a counterclockwise direction, or both. One of ordinary skill in the art will appreciate that the foot member 12 may also be sized and configured to move in a similar manner as foot member 8 depending, for example, upon the design or intended use of the table 2.

The legs 6, 10 may also be moved in any suitable manner to any suitable position relative to the table top 4. For example, the legs 6, 10 may be configured to be rotated, pivoted or otherwise moved with respect to the tabletop 4. Thus, the legs 6, 10 may be pivotally movable relative to the tabletop 4 to allow the legs to be moved between an extended position and a collapsed position. In addition, the legs 6, 10 may be rotatable relative to the tabletop 4. Thus, the foot members 8, 12 may move as the legs 6, 10 are pivoted or rotated. For example, if the leg 6 is configured to both rotate about its axis and pivot with respect to the tabletop, that the foot member 8 may rotate and pivot as the leg rotates and pivots. One of ordinary skill in the art will understand that the legs 6, 10, foot members 8, 12 and tabletop 4 may be interconnected in any suitable manner, may be configured to move in any suitable manner with respect to each other, and these components may be configured to move independently or dependently upon one or more of the other.

The table 2 may be sized and configured for use by an individual or it may be sized and configured for use by more than one person. For example, if the table 2 is sized and configured for use by a single person, then it may have a relatively small tabletop 4. On the other hand, if the table 2 is sized and configured to be used by more than one person, it may have a larger size. In addition, the table 2 may be sized and configured for particular uses, such as a personal table, computer table, game table, bedside table, night stand, television table, utility table, and the like. The table 2 may also be sized and configured for particular uses such as a desk. Thus, while the table 2 could be specifically sized and configured for a particular use or activity, the table could have various suitable configurations and arrangements depending, for example, upon the intended use of the table or it could have a general shape and design that allows it to be used in a wide variety of situations and circumstances.

As shown in the accompanying figures, the tabletop 4 may have a generally rectangular configuration with a generally concave front portion, a generally straight rear portion, and generally convex side portions. The tabletop 4 may also include generally rounded corners and slightly rounded outer edges. Desirably, the tabletop 4 is sized and configured for use by a single person. Accordingly, the tabletop 4 may be about twenty-nine (29) to thirty-two (32) inches in length and about eighteen (18 inches) to twenty (20) inches in width, but one skilled in the art will appreciate that the tabletop can have other suitable sizes and dimensions. For example, the tabletop 4 may be larger or smaller depending upon the intended use of the table 2. The tabletop 4 may also have other configurations such as square, rectangular, circular, oval, and the like depending, for example, upon the intended use of table 2.

The tabletop 4 may include beveled, sloped or rounded surfaces disposed between the top surface and the sides of the table 2. The beveled surfaces may be sized and configured to increase the comfort of the person(s) using the table 2, but the table does not require beveled surfaces. In addition, the corners and edges of the tabletop 4 do not have to be rounded and, in contrast, the corners and edges could have any desirable configuration, but the rounded features may increase the comfort and/or safety of the person(s) using the table.

The tabletop 4 is preferably constructed from a lightweight material and, more preferably, the tabletop is constructed from plastic, such as high density polyethylene. The plastic tabletop 4 is desirably formed by a blow-molding process because, for example, it allows a strong, lightweight, rigid and sturdy tabletop to be quickly and easily manufactured. Advantageously, the blow-molded plastic tabletop 4 has a lighter weight than conventional tabletops constructed from wood or metal, and the blow-molded plastic tabletop can be constructed from less plastic than conventional plastic tabletops, which may save manufacturing costs and reduce consumer costs. In particular, the blow-molded tabletop 4 can be manufactured with thin plastic walls and that allows the tabletop to cool faster during the manufacturing process, which decreases the manufacturing time.

The blow-molded plastic tabletop 4 can also be formed a variety of suitable shapes, configurations, sizes, designs and/or colors depending, for example, upon the intended use of table 2. For example, the tabletop 4 can be constructed with a generally rectangular configuration of about thirty-six (36) inches by about forty (40) inches. The tabletop 4 could also have a generally circular configuration with a diameter of about thirty (30) inches or a generally square configuration with thirty-six inch (36) sides. Of course, the blow-molded tabletop 4 can have any suitable size and configuration depending, for example, upon the intended use of the table 2.

The tabletop 4 is preferably constructed from blow-molded plastic because blow-molded plastic tabletops are generally durable, weather resistant, temperature insensitive, corrosion resistant, rust resistant and do not deteriorate over time. One of ordinary skill in the art will appreciate that the tabletop 4 does not have to be constructed from blow-molded plastic and other suitable materials and/or processes can be used to construct the tabletop depending, for example, upon the intended use of the table 2. For example, the tabletop 4 could be constructed from other types of plastic and other processes such as injection molding, compression molding, extrusion molding, and the like. In addition, the tabletop 4 could be constructed from other materials with suitable characteristics, such as wood, metal, composites, and the like.

The tabletop 4 may include one or more features that are integrally formed in the tabletop as part of a unitary, one-piece structure. For example, the tabletop 4 may include a generally downwardly extending lip that is disposed about the outer portion of the tabletop. The tabletop 4 could also include a recess that is formed in the lower surface of the tabletop. The recess may be sized and configured to receive at least a portion of leg 6, 10 and/or foot member 8, 12 when the legs are in the collapsed position. Advantageously, disposing all or a portion of the legs 6, 10 and/or foot portions 8, 12 in the recess when the legs are in the collapsed position may help facilitate stacking of the tables 2. It will be appreciated that the tabletop 4 could have any suitable number of features, but the tabletop 4 does not require any particular features or number of features.

The lower surface of the tabletop 4 may include one or more depressions. The depressions may cover at least a substantial portion of the lower surface of the tabletop 4 and the depressions may extend towards and/or contact the upper surface of the tabletop. In particular, the ends of the depressions may engage, contact or abut the inner surface of the upper surface of tabletop 4 or the ends of the depressions may be spaced from the upper surface of the tabletop. The depressions may be formed in a predetermined pattern or array, and the depressions may be placed in a staggered, geometric, random or suitable arrangement.

The depressions may be designed to increase the strength and structural integrity of the tabletop 4. While it was previously believed that stronger structures were provided by making the walls thicker and/or adding structures such as ribbing, the depressions may provide the surprising and unexpected result that an increased number of depressions may provide a stronger structure and/or thinner walls may be used to construct the structure. Surprisingly, the depressions may increase the structural integrity of the structure despite forming disruptions in the continuity of the lower surface of the tabletop 4, and less plastic can be used to make the structure even though the plurality of depressions are formed in the structure. The costs of manufacturing and transportation may be decreased because thinner plastic walls may be used to construct the tabletop 4, which may create a lighter weight table 2.

Additionally, when blow-molded structures such as tabletops 4 are formed, a certain amount of time must elapse before the structure can be removed from the mold. Blow-molded structures with thicker walls require a longer cooling time than structures with thinner walls. The depressions, however, may allow tabletops 4 with thinner plastic walls to be constructed and that reduces the cooling time before the tabletops can be removed from the mold. Significantly, a reduced cycle time may increase the efficiency of manufacturing process and the cost of the table 2 may be reduced because less plastic may be used to make the tabletop 4. Additional information regarding depressions that may be used in connection with the tabletop 4, and other structures, configurations and arrangements that may be used in connection with the table 2, are disclosed in Assignee's co-pending U.S. patent application Ser. No. 10/340,018, which was filed on Jan. 9, 2003 and co-pending U.S. patent application Ser. No. 10/612,892 which was filed on Oct. 24, 2003. Each of these applications are incorporated in their entries.

Figure 2:
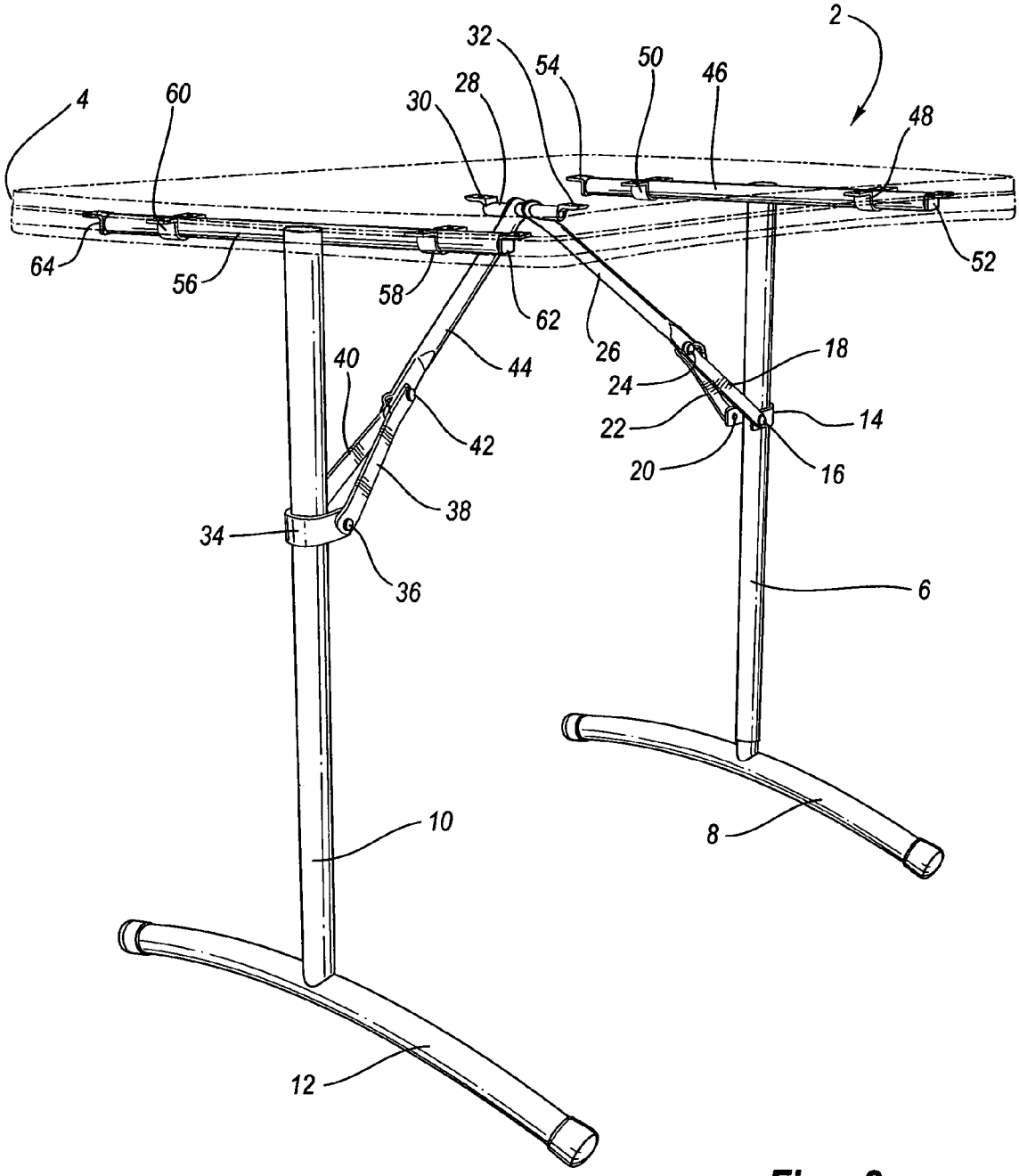
FIG. 2 is a perspective view of the table shown in FIG. 1, with the tabletop shown in broken lines.
Figure 3:
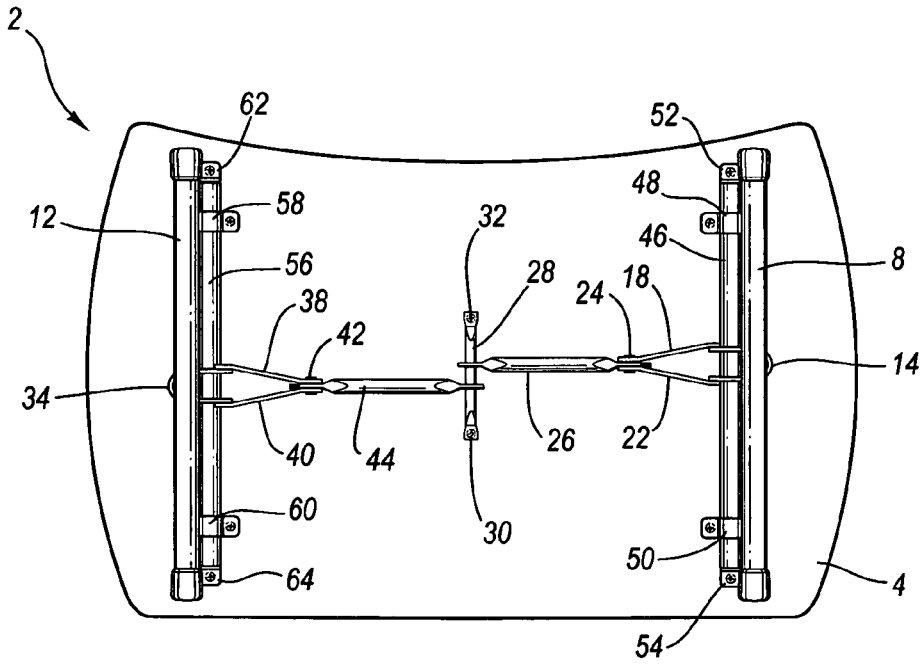
FIG. 3 is a bottom view of the table shown in FIG. 1.
Figure 4:
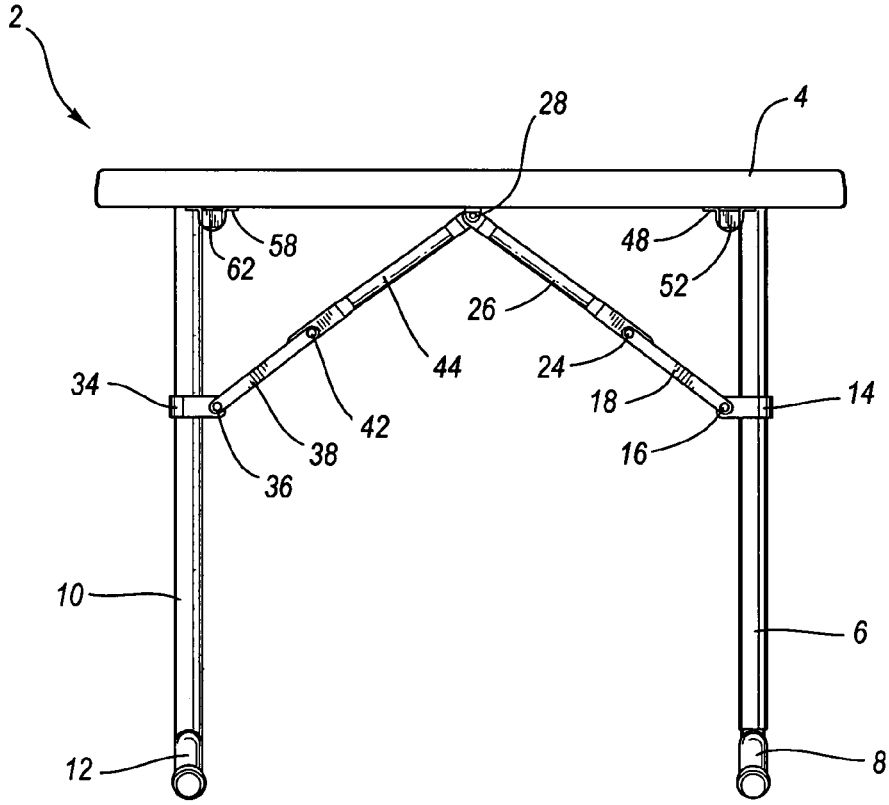
FIG. 4 is a front view of the table shown in FIG. 1.
Figure 5:
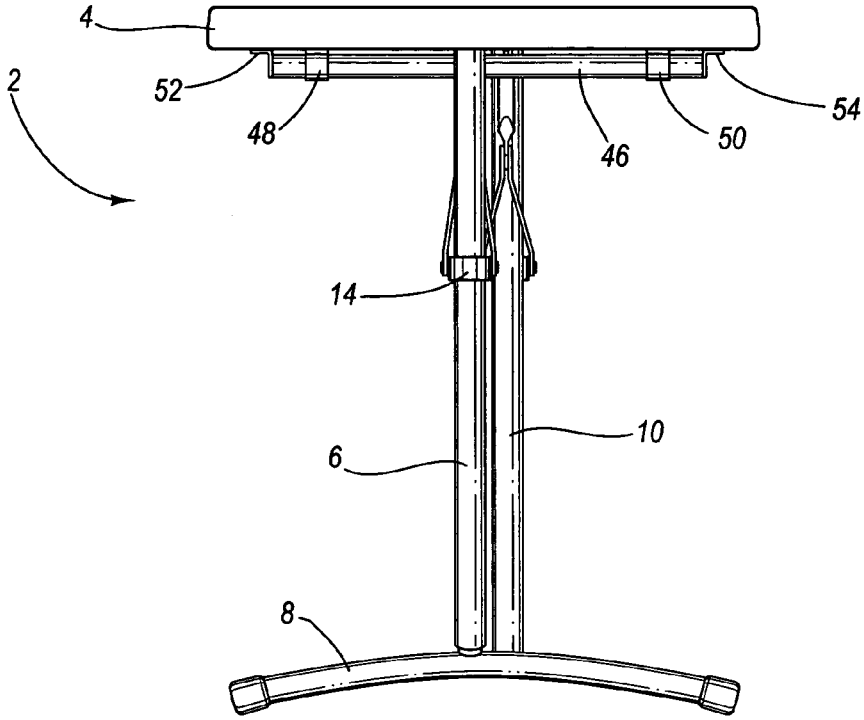
FIG. 5 is a right side view of the table shown in FIG. 1.
Figure 6:
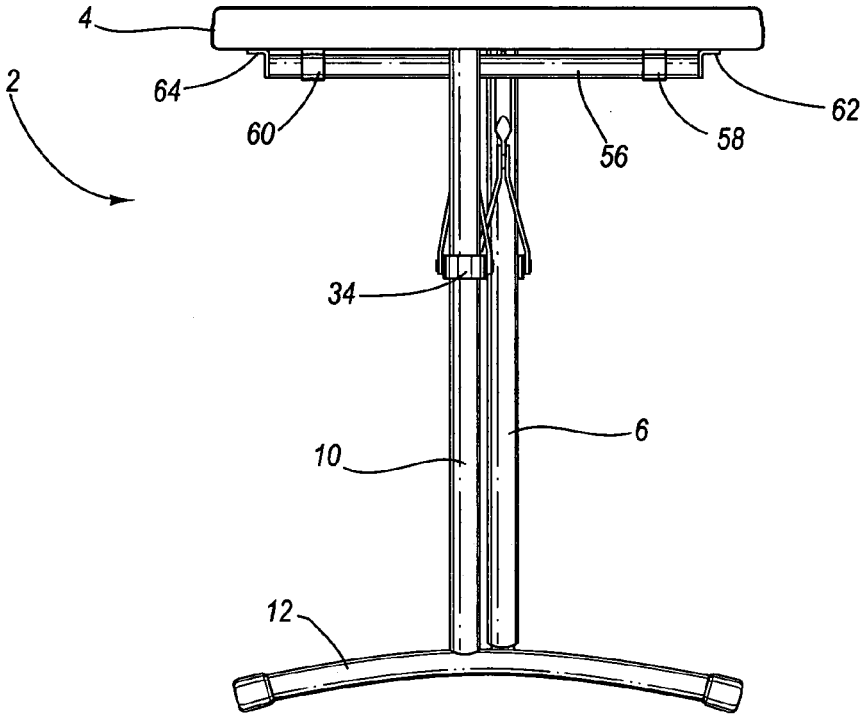
FIG. 6 is a left side view of the table shown in FIG. 1.

As shown in FIG. 2, a preferred embodiment of the table 2 includes the tabletop 4, legs 6, 10 and foot members 8, 12. A brace is preferably connected to each leg to facilitate movement of the legs between the extended and collapsed positions. In particular, a brace 18 may be connected to the leg 6 by a bracket 14. The bracket 14 is preferably securely connected to the leg 6 and the brace 18 is preferably pivotally connected to the bracket by connectors 16, 20. For example, the bracket 14 may be securely connected to the leg 6 by welding and the brace 18 may be pivotally attached to the bracket by fasteners such as rivets. One of ordinary skill in the art will appreciate that the bracket 14, brace 18 and leg 6 may be connected in any suitable manner and by any suitable type of connection. One of ordinary skill in the art will also appreciate that the brace 18 may be directly connected to the leg 6 and the bracket 14 may be pivotally connected to the leg 6, if desired.

The brace 18 may include two arms 18, 22 that are connected to the bracket 14 by the rivets 16, 20. The brace 18 may also include a third arm 26 that is pivotally connected to the other arms 18, 22 by a connector such as a rivet 24. The other end of the third arm 26 is connected to an assembly 28. The assembly 28 is preferably disposed proximate the center of the tabletop 4 and the assembly may be connected to the tabletop 4 by one or more fasteners 30, 32. The third arm 26 of the brace 18 is preferably pivotally attached to the assembly 28, but the brace may be securely connected to the assembly if desired.

An exemplary embodiment of the assembly 28 may include a rod or bar that is connected to the tabletop 4 by one or more fasteners 30, 32 or brackets. For example, the assembly 28 may include a rod or bar with a generally circular cross-sectional configuration and the rod may be inserted into an opening in the end of the brace. Advantageously, this may allow the brace 18 to be pivotally connected to the assembly 28. One skilled in the art will appreciate that the assembly 28 may have other suitable configurations and arrangements depending, for example, upon the size and configuration of the brace 18, legs 6, 10, or table 2. For example, the assembly 28 may simply consist of a plate or bracket that is attached to the tabletop 4. The assembly 28 could also include multiple rods, bars, plates, brackets, and the like depending, for example, upon the intended design and/or use of the table 2. The assembly 28 could also be connected to other portions of the table 2, if desired. For example, the assembly 28 could be connected to the frame or other portions of the table instead of being directly connected to the tabletop 4. Of course, the assembly 28 could be connected to the tabletop 4 and other portions of the table 2, if desired.

The assembly 28 could also be connected to the tabletop 4 or other portions of the table 2 by any suitable manner or structure. For example, the assembly 28 may be attached to the tabletop 4 by adhesives, welding, fasteners and the like. The assembly 28 could also be attached to the tabletop 4 by a snap, friction or interference fit. For example, the tabletop 4 could include one or more features or structures that allow the assembly 28 to be connected by a snap, friction or interference fit. One of ordinary skill in the art will appreciate that the assembly 28 may be attached to the table 2 or tabletop 4 in any suitable manner.

Similar to that discussed above, a bracket 34 may be used to attach a brace 38 to the leg 10. For example, one or more rivets 36 may be used to pivotally attach the arms 40 of the brace 38 to the leg 10 and a third arm 44 of the brace may be attached to the assembly 28. The bracket 34 and brace 38 preferably have the same general configuration and arrangement as the bracket 14 and brace 18 discussed above. One of ordinary skill in the art, however, will understand that the brackets 16, 34 and braces 18, 38 may have any suitable design or layout depending, for example, upon the intended use of the table 2.

The brackets 16, 34, braces 18, 38, and the assembly 28 are preferably sized and configured to pivotally connect the legs 6, 10 to the tabletop 4. Advantageously, the pivotal connection of the legs 6, 10 to the tabletop 4 may allow the legs to be moved between the extended and collapsed positions. It will be appreciated that the legs 6, 10, brackets 16, 34, braces 18, 38, and assembly 28 may also be connected in other suitable manners or methods. It will also be appreciated that the legs 6, 10 may be movable between the extended and collapsed positions using other suitable types or combinations of brackets, braces, assemblies, connectors and the like.

The legs 6, 10 may be directly or indirectly connected to the tabletop 4. For example, as shown in FIG. 2, the leg 6 may be connected to an elongated member 46 that is preferably positioned generally perpendicular to the longitudinal axis of the tabletop 4. The elongated member 46 may include one end that is disposed near one side of the tabletop 4 and another end that is disposed near the other side of the tabletop. The elongated member 46 may consist of an elongated rod or hollow tube with a generally circular cross-section. The elongated member 46, however, may have any suitable size and shape. For example, the elongated member 46 may have a much shorter length than shown in the accompanying figures and it may have an oblong, oval or other suitable shape. One of ordinary skill in the art will appreciate that the elongated member 46 could have any appropriate configuration and arrangement.

The elongated member 46 may be rotatably attached to the tabletop 4 using clips 48, 50 and bracket 52, 54. Advantageously, this may allow the leg 6 to be moved between the extended and collapsed positions relative to the tabletop 4. The elongated to member 46 could also be attached to the tabletop 4 or other suitable portions of the table 2 by other suitable types of brackets and connectors. In addition, the leg 6 could be pivotally attached to the elongated member 46, if desired. Thus, the leg 6 and/or elongated member 46 may be pivotal relative to the tabletop 4.

Similar to that discussed above, the leg 10 may be attached to an elongated member 56 and the elongated member may be rotatably attached to the tabletop 4 by clips 58, 60 and brackets 62, 64. Of course, the elongated members 46, 56 may be secured to the tabletop 4 in any suitable manner and/or by using any suitable types of brackets, clips or connectors. For example, the elongated members 46, 56 may be connected to the tabletop 4 by a snap fit, friction fit, interference fit, adhesives, welds, fasteners or the like.

Desirably, as shown FIG. 2, the leg 6 may be securely attached to the elongated member 46 such that, as the leg 6 is pivoted from an extended position to a retracted position, the elongated member rotates about its axis. Similarly, when the leg 10 is securely attached to the elongated member 56 and the leg is pivoted from an extended position to a retracted position, the elongated member 56 rotates about its axis. This may allow the legs 6, 10 to move between the collapsed and extended positions. One skilled in the art will understand that the legs 6, 10 may also be attached to the elongated members 46, 56 in any suitable manner, such as pivotally, rotatably, movably, or the like. One skilled in the art will also understand that the legs 6, 10 need not be attached to the elongated members, which are optional. Further, one skilled in the art will understand that the legs 6, 10, elongated members 46, 56, and foot members 8, 12 could have other suitable configurations and arrangements depending, for example, on the size and shape of the tabletop 4, the intended use of the table 2, or both.

The legs 6, 10 may be connected to the elongated members 46, 56 such that when the legs are in the extended position, an upper portion of the legs contacts the underneath surface of the tabletop 4. This may prevent the legs 6, 10 from excessively rotating relative to the tabletop 4 and it may allow a steadier and more secure table 2 to be created. The upper portion of the legs 6, 10, however, does not have to contact the tabletop 4.

The legs 6, 10, foot members 8, 12, and/or elongated members 46, 56 may be formed as separate members that are interconnected and/or integral, one-piece components. For example, the leg 10 and the foot member 12 may be separate components that are connected together or formed as an integral, one-piece component. In addition, the leg 10, foot member 12 and elongated member 56 may be separate components that are connected together or formed as an integral, one-piece component. These separate components can be interconnected by any suitable manner such as fasteners, adhesives, welding and the like. In addition, these components may be formed in any suitable manner, using any suitable number of components or subcomponents, and using one or more of any suitable types of materials, including but not limited to plastic, metal, wood, or the like. For example, while the legs 6, 10, foot members 8, 12, and elongated members 46, 56 may be constructed from hollow metal tubes with generally circular or oval cross-sections, these components could also be constructed from solid materials, have other suitable shapes and sizes, and be formed from any materials with the desired characteristics. For example, while the foot members 8, 12 may be curved, arched and/or curvilinear, the foot members could be substantially straight. Further, while the legs 6, 10 and the elongated members 46, 56 may be substantially straight, the legs and the elongated members could be curved, arched and/or curvilinear.

If the legs 6, 10, foot members 8, 12 and/or elongated members 46, 56 are constructed from steel tubes, then these components may be finished, for example, by painting or powder coating to protect the components from damage and the elements. Advantageously, the steel tubes may help create a table 2 that is strong and able to support a relatively large amount of weight, but the table may be relatively lightweight. The steel tubes may have circular, elliptical, polygonal, oblong, square or other suitable cross-sectional shapes, and these components may have a uniform or non-uniform cross-section. The legs 6, 10 foot members 8, 12, and/or elongated members 46, 56 may also be constructed from any materials with appropriate characteristics and these components can have any suitable size and shape.

As discussed above, the foot member 8 may be pivotally or rotatably connected to the leg 6. For example, the foot member 8 may include a shaft 66 that is inserted into an opening 68 in the lower portion of the leg 6 to allow the foot member to pivot or rotate relative to the leg. Of course, the foot member 8 may be moved, pivoted or rotated in any suitable manner, to any suitable position, using any other suitable system or device. For example, the shaft 66 could include threads that engage threads formed within the opening 68 in the lower portion of the leg 6. In this exemplary embodiment, rotating the foot member 8 relative to the leg 6 may allow the shaft 66 to be fully, partially or disconnected from the leg. This may also allow the foot member 8 to be located in various positions relative to the leg 6 and/or tabletop 4 by rotating the shaft 66 within the opening 68. Of course, a foot member 8 may be connected to the leg 6 by any suitable system or process, including but not limited to thread-based systems or non-thread-based systems.

The foot member 8 may also be locked in a desired position. For example, if the shaft 66 is threadably attached to the lower portion of the leg 6, then the foot member 8 may be locked in a desired position when the shaft is fully screwed into the lower portion of the leg. The foot member 8 may also be locked into other desired positions using other suitable systems, including but not limited to thread-based systems or non-thread-based systems. One of ordinary skill in the art will appreciate that various suitable devices may be used to lock the foot member in a particular position, such as a snap fit, interference fit, pin, force-loaded pin (e.g., a spring loaded pin or the like), latch, detent or the like. The pin, force-loaded pin, latch, detent or the like may be attached to any desired portion and location, including but not limited to one or more of the foot member, a leg, or a shaft.

As discussed above, the legs 6, 10 are preferably movable between extended and collapsed positions relative to the tabletop 4. Advantageously, the legs 6, 10 are sized and configured to allow the legs to be quickly and efficiently moved between the extended and collapsed positions. In particular, the legs 6, 10 are preferably sized and configured to allow the legs to be positioned generally adjacent and/or parallel to each other when the legs are in the collapsed position. Significantly, the legs 6, 10 may allow the foot member of one leg to be positioned near the elongated member of the other leg when the legs are in the collapsed position. Importantly, this may allow the height of the table 2 to be decreased when the legs 6, 10 are in the collapsed position. This may facilitate shipping because the table 2 takes up less space, which may allow more tables to be placed within a shipping container. This may also decrease the size of the packaging in which the table may be shipped and/or stored.

As shown in FIGS. 1–6, the legs 6, 10 are shown in the extended position and the tabletop 4 may be support above a surface such as the floor. When it is desired to move the legs 6, 10 from the extended position to the collapsed position, the legs may be moved as shown in FIGS. 7A–7D. Advantageously, this allows a table, such as a personal-sized table, to include legs that can be readily moved between the extended and collapsed positions. Significantly, neither of the legs 6, 10 have to be disconnected from the tabletop 4 and the legs can be positioned near or adjacent to each other when the legs are in the collapsed position. In addition, when the legs 6, 10 are in the collapsed position, the legs may be generally or completely disposed within a boundary defined by the outer edges of the table top. That is, when the legs 6, 10 are in the collapsed position, the legs and/or foot members 8, 12 may not extend beyond the front, rear or sides of the tabletop 4. Importantly, this may allow the table 2 to be more easily shipped and stored. One skilled in the art, however, will appreciate that all or a portion of the legs 6, 10 and/or foot members 8, 12 may extend beyond the front, rear or sides of the tabletop 4.

Figure 7A:
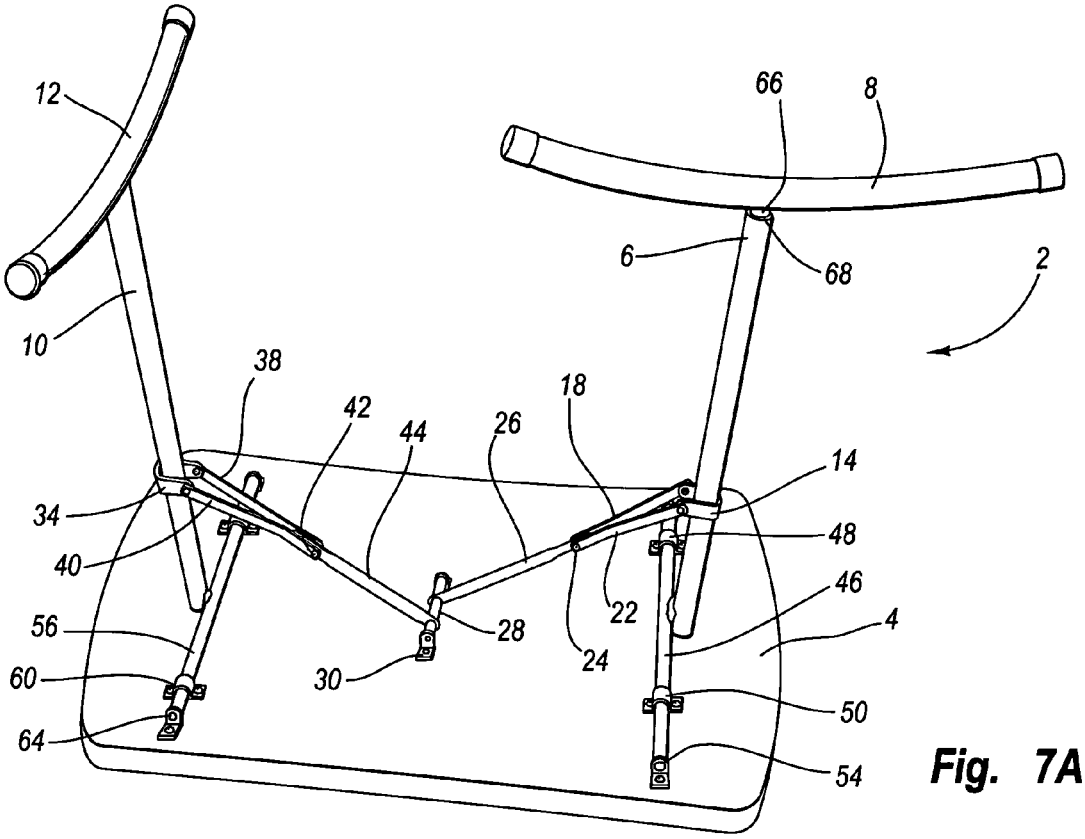
FIG. 7A is a bottom perspective view the table shown in FIG. 1, illustrating the legs in an extended position and one of the foot members a rotated position.
Figure 7B:
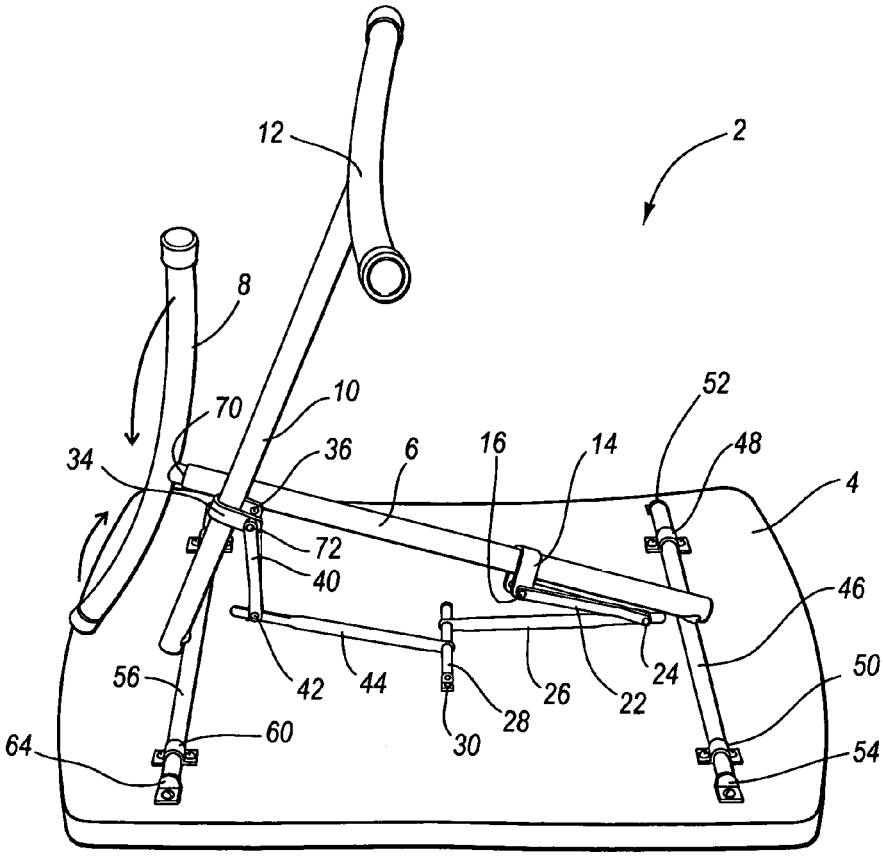
FIG. 7B is a bottom perspective view of the table shown in FIG. 1, illustrating one of the legs in an intermediate position and its foot member in a rotated position and the other leg is a partially collapsed position.

In order to move the legs 6, 10 between the extended and collapsed positions, the legs may be moved as shown in FIGS. 7A to 7D. For example, as shown in FIG. 7A, the foot member 8 may be rotated from its normal, first position into a rotated, second position. Preferably, the foot member 8 is disposed at about a ninety degree angle such that the foot member is generally aligned parallel to a longitudinal axis of the tabletop 4. As shown in FIG. 7B, the leg 10 may be pivoted or rotated slightly towards the tabletop 4 and the brace 40 may begin to collapse. In addition, the leg 6 has been pivoted or rotated towards the tabletop 4 such that the foot member 8 is now disposed on the other side of the leg 10 and the brace 18 is nearing the closed position. Accordingly, the legs 6, 10 have pivoted towards the tabletop 4 such that the end 70 of the leg 6 is now disposed on the other side of the leg 10.

Figure 7C:
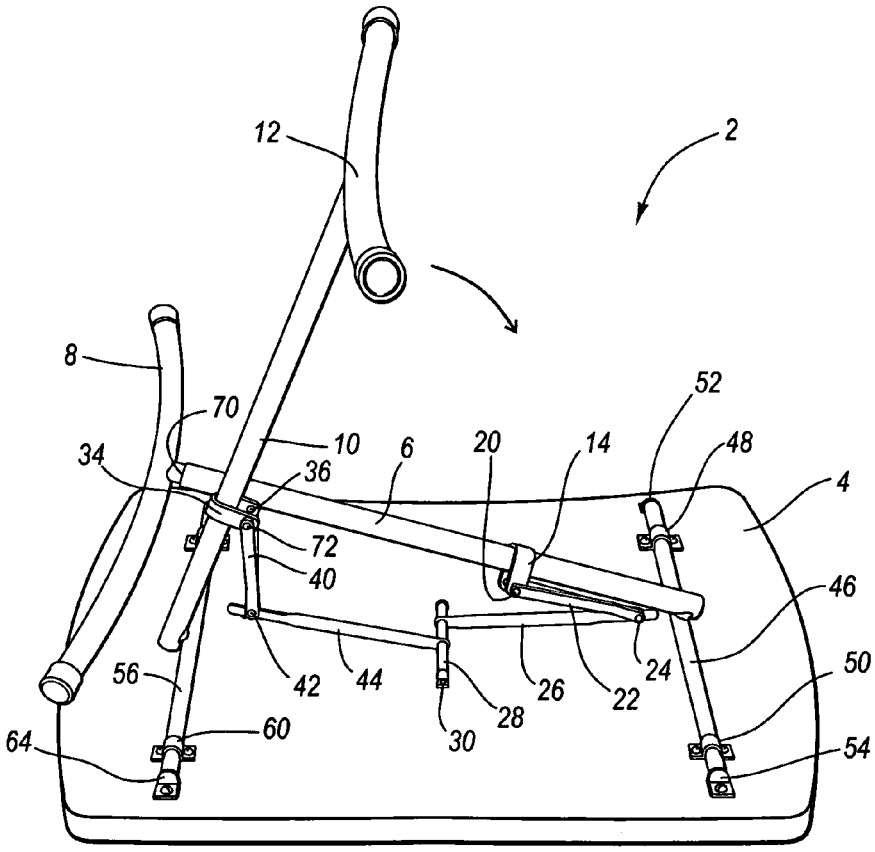
FIG. 7C is a bottom perspective view of the table shown in FIG. 1, illustrating one of the legs in the intermediate position and its foot member in a normal position and the other leg in the partially collapsed position.

As shown in FIG. 7C, the foot member 8 is now rotated back to its first, original position such that it is disposed generally perpendicular to the longitudinal axis of the tabletop 4. This allows the leg 6 to be rotated further towards the underneath surface of the tabletop 4.

Figure 7D:
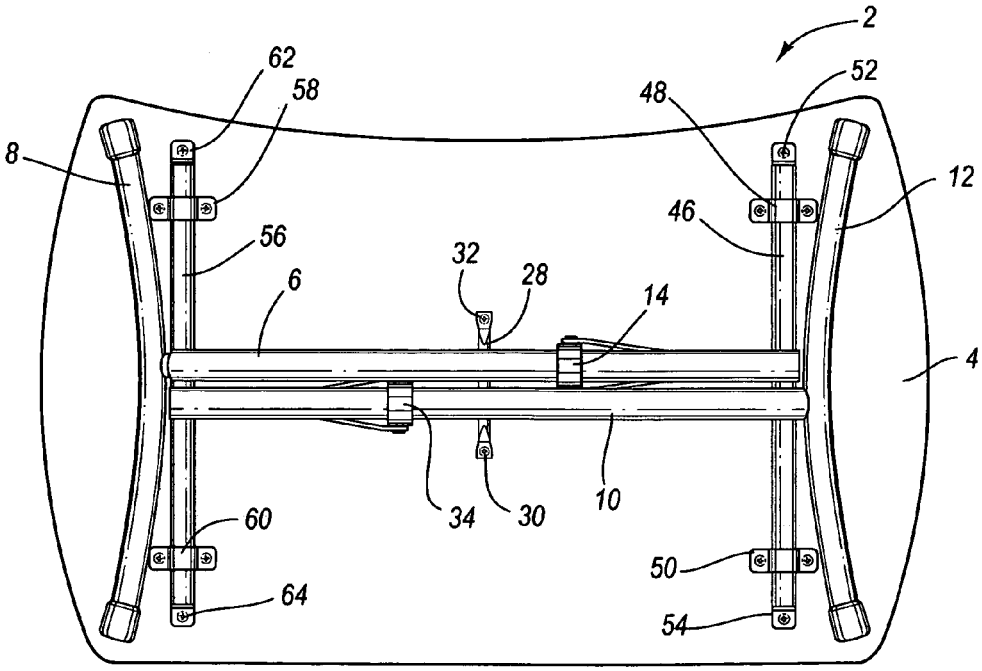
FIG. 7D is a bottom view of the table shown in FIG. 1, illustrating the legs in the collapsed position.
Figure 8:
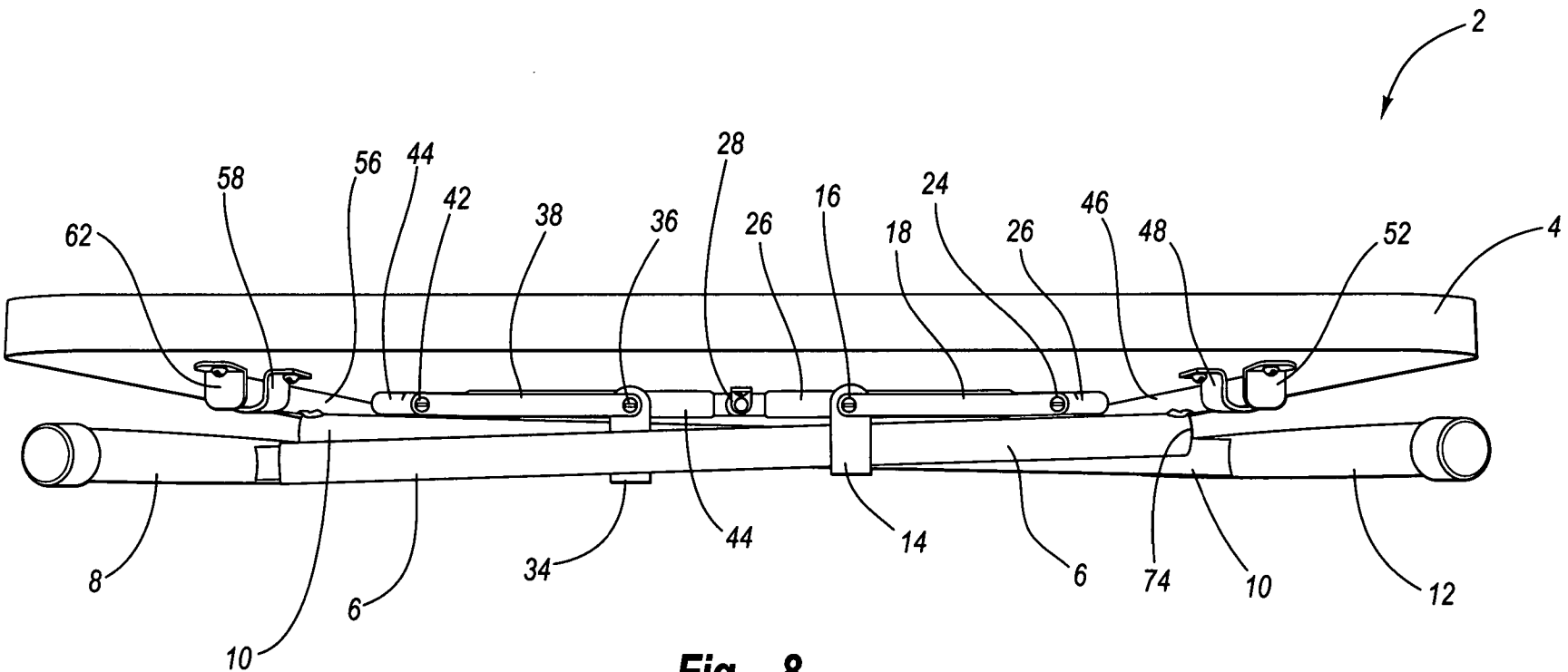
FIG. 8 is a front view of the table in shown FIG. 1, illustrating the legs in the collapsed position.

As shown in FIG. 7D, the leg 6 is now rotated so that the leg is generally parallel and adjacent to the lower surface of the tabletop 4. The leg 10 can also be rotated such that this leg is generally parallel and adjacent to the lower surface of the tabletop 4. When the legs 6, 10 are in the collapsed position, the braces 18, 40 are also in a collapsed position. Accordingly, the legs 6, 10 may now be substantially parallel to the lower surface of the tabletop 4. By being positioned compactly, as illustrated in FIG. 7D and FIG. 8, table 2 may require less space for transportation and storage. Of course, the leg 6, 10 do not have to be positioned substantially parallel to the lower surface of the tabletop 4 when the legs are in the collapsed position. One of ordinary skill in the art will appreciate that the legs 6, 10 and foot members 8, 12 move be pivoted or moved in any suitable manner or method.

As discussed above, the table 2 shown in the accompanying figures is preferably sized and configured to be used as a personal-sized table. For example, in one exemplary embodiment, the table 2 may have the following dimensions: each end of the foot member 12 may touch the floor at about twenty (20) inches apart; one end of the foot member 12 may be about 10 inches from the leg 10; the other end of the foot member 12 may be about nine (9) inches from the leg 10; the leg may have a diameter of about one (1) inch; the bracket 34 may be positioned about fourteen (14) inches above the foot member 12; the bracket 34 may be about one (1) inch in height; the bracket 34 may be about eight (8) inches below the end of the leg 10; the leg 10 may be twenty-three (23) inches in length; the elongated member 56 may be about sixteen (16) inches in length; and the tabletop 4 may be positioned about twenty-six (26) inches from the floor. In other embodiments, the table 2 may have any suitable dimensions, sizes and configurations depending, for example, upon the intended purpose and/or use of table.

One of ordinary skill in the art will appreciate that although the exemplary embodiments discussed above have been described with respect to tables, these aspects and features may also be used in connection with other types of furniture such as chairs, stools, footstools, or any other suitable type of devices or fixtures.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a tabletop including a first side and a second side;

a first crossbar connected to the first side of the tabletop;

a second crossbar connected to the second side of the tabletop;

a first leg including a first end and a second end, the first end of the first leg connected to the first crossbar, the first leg being movable between an extended position and a collapsed position relative to the tabletop;

a second leg including a first end and a second end, the first end of the second leg connected to the second crossbar, the second leg being movable between an extended position and a collapsed position relative to the tabletop;

a first elongated foot member including a first end and a second end, the first elongated foot member rotatably connected to the second end of the first leg, the first elongated foot member being movable between a first position in which the first elongated foot member is disposed generally parallel to the first crossbar and a second position in which the first elongated foot member is disposed at an angle relative to the first crossbar; and a second elongated foot member including a first end and a second end, the second elongated foot member connected to the second end of the second leg;

wherein the first elongated foot member is rotated between the first position and the second position to allow the first leg and the second leg to be moved between the extended and the collapsed positions; and wherein the first elongated foot member is rotated from the second position to the first position to allow the first elongated foot member to be disposed proximate the table top when the first leg is in the collapsed position.

2. The table as in claim 1, wherein the first crossbar and second crossbar are rotatably connected to the tabletop.

3. The table as in claim 1, wherein the second elongated foot member is rotatably connected to the second leg.

4. The table as in claim 1, further comprising an assembly at least partially disposed between the first leg and the second leg; and further comprising a first brace that interconnects the first leg and the assembly; and further comprising a second brace that interconnects the second leg and the assembly.

5. The table as in claim 1, wherein the tabletop is constructed from blow-molded plastic.

6. The table as in claim 1, wherein the first leg and the second leg are disposed generally adjacent and parallel to each other when the first leg and the second leg are in the collapsed position.

7. The table as in claim 1, wherein the first elongated foot member is disposed proximate to the second crossbar and the second elongated foot member is disposed proximate the first crossbar when the first leg and the second leg are in the collapsed position.

8. The table as in claim 1, wherein the first leg, the second leg, the first elongated foot member and the second elongated foot member do not extend beyond an outer edge of the tabletop when the first leg and the second leg are in the collapsed position.

9. The table as in claim 1, wherein the first leg and the second leg are disposed generally adjacent and parallel to each other when the first leg and the second leg are in the collapsed position; and wherein the first elongated foot member is disposed proximate to the second crossbar and the second elongated foot member is disposed proximate the first crossbar when the first leg and the second leg are in the collapsed position.

10. A table comprising:

a tabletop;

a first leg movable between an extended position and a collapsed position relative to the tabletop;

a second leg movable between an extended position and a collapsed position relative to the tabletop;

a first elongated foot member including a first end and a second end, the first elongated foot member being rotatably connected to the first leg, the first elongated foot member being movable between a first position and a second position; and a second elongated foot member including a first end and a second end, the second elongated foot member being connected to the second end of the second leg;

wherein the first elongated foot member is disposed in the first position and the first elongated foot member is disposed generally parallel to the second elongated foot member when the first leg and the second leg are disposed in the extended positions to facilitate use of the table;

wherein the first foot member is rotated between the first position and the second position to allow the first leg and the second leg to be moved between the extended and collapsed positions; and wherein the first elongated foot member is rotated from the second position to the first position to allow the first elongated foot member to be disposed proximate the table top when the first leg is in the collapsed position.

11. The table as in claim 10, wherein the second elongated foot member is rotatably connected to the second leg.

12. The table as in claim 10, further comprising an assembly at least partially disposed between the first leg and the second leg; and further comprising a first brace that interconnects the first leg and the assembly; and further comprising a second brace that interconnects the second leg and the assembly.

13. The table as in claim 10, wherein the tabletop is constructed from blow-molded plastic.

14. The table as in claim 10, wherein the first leg and the second leg are disposed generally adjacent and parallel to each other when the first leg and the second leg are in the collapsed position.

15. The table as in claim 10, wherein the first elongated foot member is disposed proximate a first end of the second leg and the second elongated foot member is disposed proximate a first end of the first leg when the first leg and the second leg are in the collapsed position.

16. The table as in claim 10, wherein the first leg, the second leg, the first elongated foot member and the second elongated foot member do not extend beyond an the outer edge of the tabletop when the first leg and the second leg are in the collapsed position.

17. The table as in claim 10, wherein the first leg and the second leg are disposed generally adjacent and parallel to each other when the first leg and the second leg are in the collapsed position; and wherein the first elongated foot member is disposed proximate a first end of the second leg and the second elongated foot member is disposed proximate a first end of the first leg when the first leg and the second leg are in the collapsed position.

18. A table comprising:

a tabletop;

a first leg assembly movable between an extended position and a collapsed position relative to the tabletop, the first leg assembly including an elongated support member and an elongated foot, the elongated foot being movable between a first position and a second position;

a second leg assembly movable between an extended position and a collapsed position relative to the tabletop, the second leg assembly including an elongated support member and an elongated foot;

wherein the elongated foot of the first leg assembly is disposed in the first position when the first leg assembly and the second leg assembly are disposed in the extended positions to facilitate use of the table;

wherein the elongated foot of the first leg assembly is moved from the first position to the second position to allow the first leg assembly and the second leg assembly to be moved from the extended positions to the collapsed positions; and wherein the elongated foot of the first leg assembly is rotated from the second position to the first position to allow the elongated foot to be disposed proximate the table top when the first leg assembly is in the collapsed position.

19. The table as in claim 18, wherein the elongated support of the first leg assembly and the elongated support of the second leg assembly are disposed generally adjacent and parallel to each other when the first leg assembly and the second leg assembly are in the collapsed positions.

20. The table as in claim 18, wherein the elongated foot of the first leg assembly is disposed proximate a first end of the second leg assembly when the first leg assembly is in the collapsed position; and wherein the elongated foot of the second leg assembly is disposed proximate a first end of the first leg assembly when the second leg assembly is in the collapsed position.

21. The table as in claim 18, wherein the elongated foot of the first leg assembly and the elongated foot of the second leg assembly do not extend beyond an outer edge of the tabletop when the first leg assembly and the second leg assembly are in the collapsed positions.

22. The table as in claim 18, wherein the elongated support of the first leg assembly and the elongated support of the second leg assembly are disposed generally adjacent and parallel to each other when the first leg assembly and the second leg assembly are in the collapsed positions; and wherein the elongated foot of the first leg assembly is disposed proximate a first end of the second leg assembly and the elongated foot of the second leg assembly is disposed proximate a first end of the first leg assembly when the first leg assembly and the second leg assembly are in the collapsed positions.

23. A table comprising:

a tabletop;

a first leg assembly movable between an extended position and a collapsed position relative to the tabletop, the first leg assembly including an elongated support member and an elongated foot, the elongated foot being movable between a first position and a second position;

a second leg assembly movable between an extended position and a collapsed position relative to the tabletop, the second leg assembly including an elongated support member and an elongated foot;

wherein the elongated foot of the first leg assembly is disposed in the first position when the first leg assembly is disposed in the extended position to facilitate use of the table, the elongated foot of the first leg assembly being disposed generally parallel to the elongated foot of the second leg assembly when the first leg assembly and the second leg assembly are in the extended positions;

wherein the elongated foot of the first leg assembly is disposed in the second position to allow the first leg assembly and the second leg assembly to be moved from the extended positions to the collapsed positions; and wherein the elongated foot of the first leg assembly is disposed in the first position to allow the elongated foot to be disposed proximate the table top when the first leg assembly is in the collapsed position.

24. The table as in claim 23, wherein the elongated support of the first leg assembly and the elongated support of the second leg assembly are disposed generally adjacent and parallel to each other when the first leg assembly and the second leg assembly are in the collapsed positions.

25. The table as in claim 23, wherein the elongated foot of the first leg assembly is disposed proximate a first end of the second leg assembly when the first leg assembly is in the collapsed position; and wherein the elongated foot of the second leg assembly is disposed proximate a first end of the first leg assembly when the second leg assembly is in the collapsed position.

26. The table as in claim 23, wherein the elongated foot of the first leg assembly and the elongated foot of the second leg assembly do not extend beyond an outer edge of the tabletop when the first leg assembly and the second leg assembly are in the collapsed positions.

27. The table as in claim 23, wherein the elongated support of the first leg assembly and the elongated support of the second leg assembly are disposed generally adjacent and parallel to each other when the first leg assembly and the second leg assembly are in the collapsed positions; and wherein the elongated foot of the first leg assembly is disposed proximate a first end of the second leg assembly and the elongated foot of the second leg assembly is disposed proximate a first end of the first leg assembly when the first leg assembly and the second leg assembly are in the collapsed positions.

* * * * *

UNITED STATES PATENT AND TRADEMARK OFFICE

CERTIFICATE OF CORRECTION

PATENT NO. : 7,036,437 B2 
APPLICATION NO. : 10/848445
DATED : May 2, 2006
INVENTOR(S) : Choi et al.

It is certified that error appears in the above-identified patent and that said Letters Patent is hereby corrected as shown below:

Column 6
Line 12, change “leg” to --legs--

Column 8
Line 32, after “formed”, insert --to be--
Line 40, change “inch (36)” to --(36) inch--

Column 10
Line 56, change “16” to --14--
Line 59, change “16” to --14--
Line 65, change “16” to --14--

Column 11
Line 24, after “elongated”, remove [to]

Column 13
Line 26, change “support” to --supported--

Column 16
Line 34, before “outer”, remove [the]

Signed and Sealed this

Twenty-first Day of November, 2006

JON W. DUDAS
*Director of the United States Patent and Trademark Office*